US009072344B2

(12) United States Patent
Yen

(10) Patent No.: US 9,072,344 B2
(45) Date of Patent: Jul. 7, 2015

(54) COVER BUCKLE STRUCTURE

(71) Applicant: Ying-Chuan Yen, Yuanlin Township, Changhua County (TW)

(72) Inventor: Ying-Chuan Yen, Yuanlin Township, Changhua County (TW)

( * ) Notice: Subject to any disclaimer, the term of this patent is extended or adjusted under 35 U.S.C. 154(b) by 206 days.

(21) Appl. No.: 13/920,119

(22) Filed: Jun. 18, 2013

(65) Prior Publication Data

US 2014/0367426 A1 Dec. 18, 2014

(51) Int. Cl.

*A45F 5/00* (2006.01)
*A44B 11/00* (2006.01)
*A44B 11/26* (2006.01)

(52) U.S. Cl.

CPC ..... *A44B 11/005* (2013.01); *A45F 5/00* (2013.01); *A45F 2005/002* (2013.01); *Y10T 24/45529* (2015.01); *Y10T 24/45534* (2015.01); *Y10T 24/45524* (2015.01); *A44B 11/263* (2013.01)

(58) Field of Classification Search

CPC ..... A44B 11/005; A44B 11/263; A45F 5/00; A45F 2005/002; Y10T 24/45524; Y10T 24/45529; Y10T 24/45534
USPC ..... 24/614, 615, 616; 224/163
See application file for complete search history.

(56) References Cited

U.S. PATENT DOCUMENTS

| | | | | | |
|---|---|---|---|---|---|
| 4,800,629 | A * | 1/1989 | Ikeda | 24/170 |
| 5,465,472 | A * | 11/1995 | Matoba | 24/616 |
| 5,561,891 | A * | 10/1996 | Hsieh | 24/615 |
| 6,161,266 | A * | 12/2000 | Anscher | 24/615 |
| 6,360,410 | B1 * | 3/2002 | Lovato | 24/170 |
| 6,711,785 | B1 * | 3/2004 | Hicks et al. | 24/625 |
| 8,720,018 | B2 * | 5/2014 | Yoshie et al. | 24/615 |
| 2007/0079486 | A1 * | 4/2007 | Paik | 24/615 |
| 2011/0219590 | A1 * | 9/2011 | Anscher | 24/606 |
| 2013/0205551 | A1 * | 8/2013 | Wang | 24/639 |

* cited by examiner

*Primary Examiner* — Robert J Sandy
(74) *Attorney, Agent, or Firm* — Alan D. Kamrath; Kamrath IP Lawfirm, P.A.

(57) ABSTRACT

A cover buckle structure contains a male buckle, a female buckle, a receiving groove, and a cover. The male buckle includes two resilient retainers disposed on two sides thereof, each resilient retainer has a positioning projection fixed on a front end thereof. The female buckle includes two openings defined on two sides thereof, and each opening has a locking block mounted therein. The receiving groove is formed on a back surface of the female buckle and includes a connecting shaft pivoted on a rear end thereof and a slot arranged on a front end thereof. The cover includes a C-shaped notch defined on a rear end of the cover so as to fit the connecting shaft and includes an engaging button fixed on a front end of the cover and retained into the slot.

1 Claim, 3 Drawing Sheets

COVER BUCKLE STRUCTURE

FIELD OF THE INVENTION

The present invention relates to a cover structure which locks the female buckle and the male together to offer a storing space in the back side of the female buckle.

BACKGROUND OF THE INVENTION

A conventional buckle structure does not have a space to store objects.

The present invention has arisen to mitigate and/or obviate the afore-described disadvantages.

SUMMARY OF THE INVENTION

The primary object of the present invention is to provide a cover structure which locks the female buckle and the male together to offer a storing space in back side of the female buckle.

To obtain the above objectives, a cover buckle structure contains a male buckle, a female buckle, a groove in the female buckle, and a cover.

The male buckle includes two resilient retainers disposed on two sides thereof, each resilient retainer has a positioning projection fixed on a front end thereof.

The female buckle includes two openings defined on two sides thereof, and each opening has a locking block mounted therein.

The receiving groove is formed on the back surface of the female buckle and includes a connecting shaft pivoted on a rear end thereof and a slot arranged on a front end thereof.

The cover includes a C-shaped notch defined on a rear end of the cover so as to fit the connecting shaft and includes an engaging button fixed on a front end of the cover and retained into the slot.

DETAILED DESCRIPTION OF THE PREFERRED

Embodiments

Figure 1:
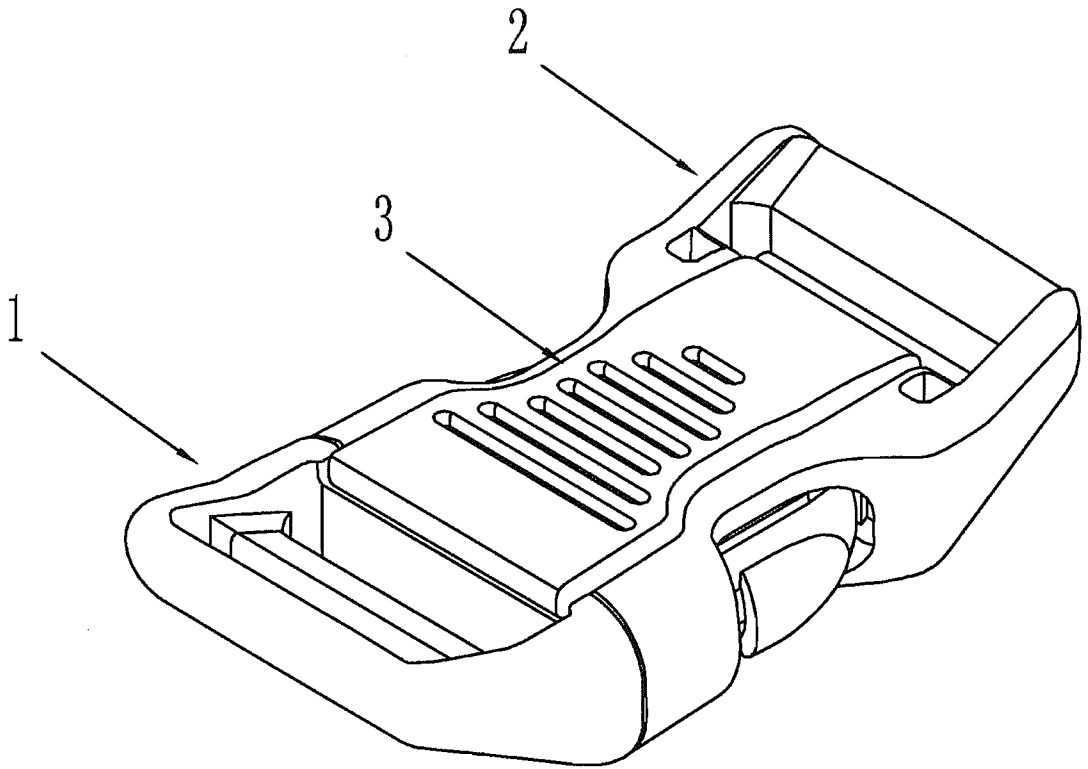
FIG. 1 is a perspective view showing the assembly of a cover buckle structure according to a preferred embodiment of the present invention.
Figure 2:
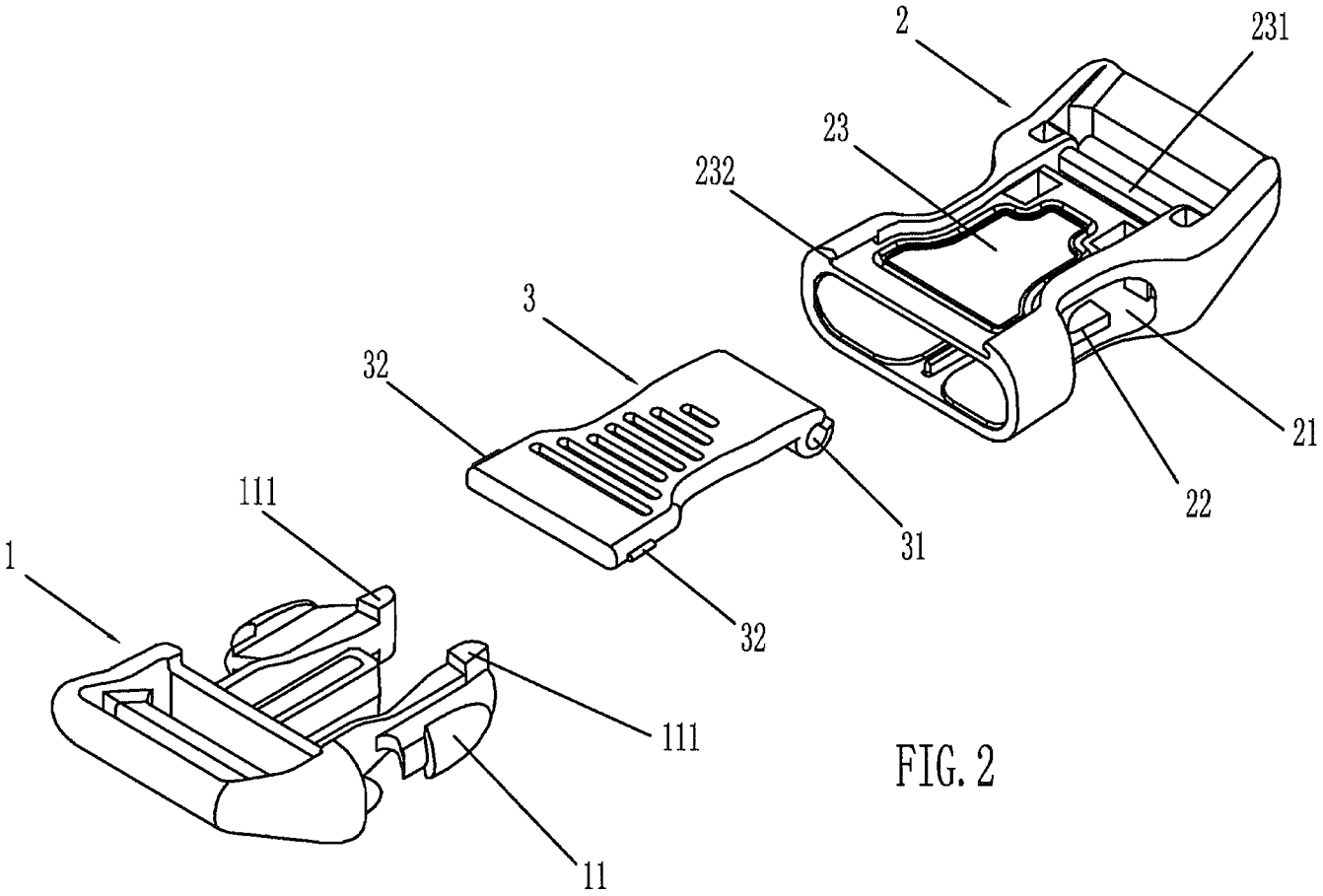
FIG. 2 is a perspective view showing the exploded components of the cover buckle structure according to the preferred embodiment of the present invention.
Figure 3:
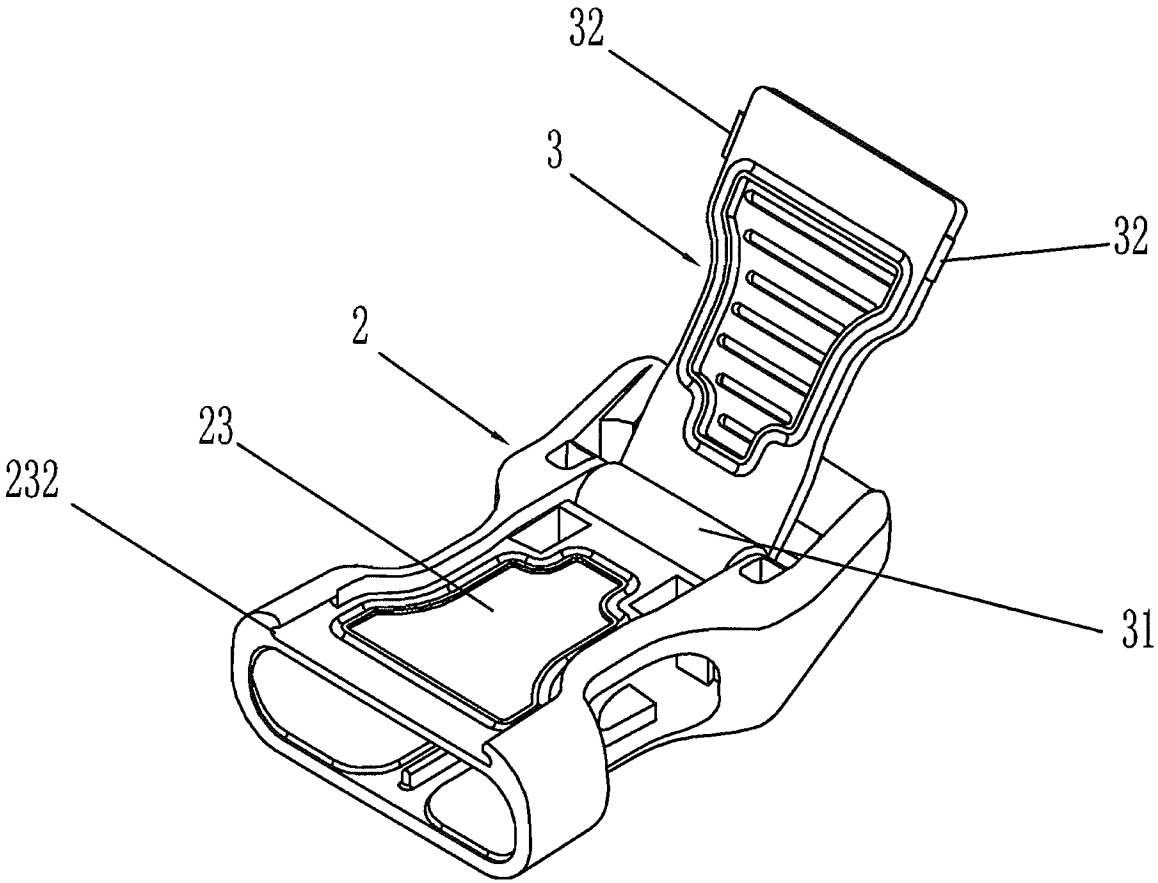
FIG. 3 is a perspective view showing the assembly of a female buckle and a cover of the cover buckle structure according to the preferred embodiment of the present invention.

FIG. 1 is a perspective view showing the assembly of a cover buckle structure according to a preferred embodiment of the present invention. FIG. 2 is a perspective view showing the exploded components of the cover buckle structure according to the preferred embodiment of the present invention. FIG. 3 is a perspective view showing the assembly of a female buckle and a cover of the cover buckle structure according to the preferred embodiment of the present invention. A cover buckle structure according to a preferred embodiment of the present invention contains: a male buckle 1, and the male buckle 1 including two resilient retainers 11 disposed on two sides thereof, each resilient retainer 11 having a positioning projection 111 fixed on a front end thereof; a female buckle 2, the female buckle 2 including two openings 21 defined on two sides thereof, and each opening 21 having a locking block 22 mounted therein; a receiving groove 23 formed on a back surface of the female buckle 2, and the receiving groove 23 including a connecting shaft 231 pivoted on a rear end thereof and a slot 232 arranged on a front end thereof;

a cover 3 including a C-shaped notch 31 defined on a rear end of the cover 3 so as to fit the connecting shaft 231 and including an engaging button 32 fixed on a front end of the cover 3 and retained into the slot 232.

Thereby, the receiving groove 23 of the rear end of the male buckle 2 is used to store an object. In Operation, the two resilient retainers 11 of the male buckle 1 are inserted into the female 2 and are retained into the two openings 21, such that two positioning projections 111 of the two resilient retainers 11 engage with two locking blocks 22 of the two openings 21, and the object is stored in the receiving groove 23 of the female 2, thereafter the cover 3 is covered on the receiving groove 23, the engaging button 32 is retained in the slot 232, thus locking the male buckle 1 and the female 2 together and storing the object in the rear end of the male buckle 2.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A cover buckle structure comprising:

a male buckle, and the male buckle including two resilient retainers disposed on two sides thereof, each resilient retainer having a positioning projection fixed on a front end thereof;

a female buckle, the female buckle including two openings defined on two sides thereof, and each opening having a locking block mounted therein;

a receiving groove formed on a back surface of the female buckle, and the receiving groove including a connecting shaft pivoted on a rear end thereof and a slot arranged on a front end thereof;

a cover including a C-shaped notch defined on a rear end of the cover so as to fit the connecting shaft and including an engaging button fixed on a front end of the cover and retained into the slot.

* * * * *